US005320554A

United States Patent [19]

Freer et al.

[11] Patent Number: 5,320,554

[45] Date of Patent: Jun. 14, 1994

[54] ATTACHMENT UNIT INTERFACE CONNECTOR

[75] Inventors: Raymond A. Freer, Houston; Joseph R. Allen, Tomball; James A. Mouton, Cypress, all of Tex.

[73] Assignee: Compaq Computer Corp., Houston, Tex.

[21] Appl. No.: 955,668

[22] Filed: Oct. 2, 1992

[51] Int. Cl.[5] ..... H01R 4/50

[52] U.S. Cl. ..... 439/347; 439/545

[58] Field of Search ..... 439/346, 347, 352, 353, 439/354, 373, 324, 545, 562, 563

[56] References Cited

U.S. PATENT DOCUMENTS 4,367,003 1/1983 Frantz ..... 439/347
4,671,594 6/1987 Ohtsuki et al. ..... 439/347
4,880,392 11/1989 Schieferly ..... 439/347
4,995,826 2/1991 Schieferly ..... 439/347
5,123,858 6/1992 Haag et al. ..... 439/347
5,169,332 12/1992 Cooke et al. ..... 439/347 X

*Primary Examiner*—Larry I. Schwartz
*Assistant Examiner*—Khiem Nguyen
*Attorney, Agent, or Firm*—Pravel, Hewitt, Kimball & Krieger

[57] ABSTRACT

An attachment unit interface electrical connector which includes a slide latch which is moveable between open and close positions utilizing a pivotally mounted tab member. The pivotally mounted tab member is mounted onto the slidably mounted latch so that the latch member is accessible even when the attachment unit interface female connector is attached to a male connector in an area of confinement.

6 Claims, 2 Drawing Sheets

ATTACHMENT UNIT INTERFACE CONNECTOR

FIELD OF THE INVENTION

The invention relates to an improvement in attachment unit interface electrical connectors, known as "AUI" connectors.

BACKGROUND OF THE INVENTION

An attachment unit interface connector, commonly called in the computer industry an "AUI connector" is a multiple pin-type connector which utilizes a slidable latch to attach the male and female connectors together. The female connector includes a central multi-port terminal arrangement of pins typically housed within a shell sometimes referred to as a "D" shell. The female connector further includes first and second mounting pins positioned on each side of the D shell. Each mounting pin includes a circular recess which receives the base of a sliding latch, which is slidably mounted for movement between latch open and latch closed positions.

The latch base includes spaced, tabbed end portions having slots which may be moved to positions of non-engagement or engagement with attachment pins of a male connector.

When the male and female AUI connectors are connected together by the latch, the edges of the slots in the spaced end portions of the latch actually engage the attachment pins of the male connector to maintain the male and female connectors in tight electrical connection. This latch has proved to be extremely successful and is commonly used.

However, oftentimes, the AUI connectors are used in situations where access to the latch for opening or closing the latch is extremely limited. For example, an option card for a computer may include several connectors mounted in the same slot in the rear panel of the computer housing. The proximity of the AUI connector to other connectors located in the same slot may prevent one from easily accessing the latch to move the latch to open and closed positions. Insofar as known, no one has developed a way to make this latch more accessible so that the AUI connection may be more easily connected and disconnected.

SUMMARY OF THE INVENTION

It is the object of this invention to provide a new and improved attachment unit interface connector which includes a slidable latch which is readily accessible for engaging and disengaging the connection even though the attachment unit interface connector is in a confined area such as in a system card slot in a computer.

This object and other objects of this invention are carried out by mounting onto a slidable latch assembly of an attachment unit interface connector a suitable tab or actuation member for purposes of moving the slidable latch between latch open and latch close positions. The tab member is a rigid wire member which extends outwardly from attachment to the latch so that one may move the latch between latch open and latch close positions by as little as one finger.

This description is intended to be a general summary only of this invention, which will be described with particularity in the Description of the Preferred Embodiment. The scope of the patent protection sought and obtained will be set forth in the claims to follow.

DESCRIPTION OF THE PREFERRED EMBODIMENT

Figure 1:
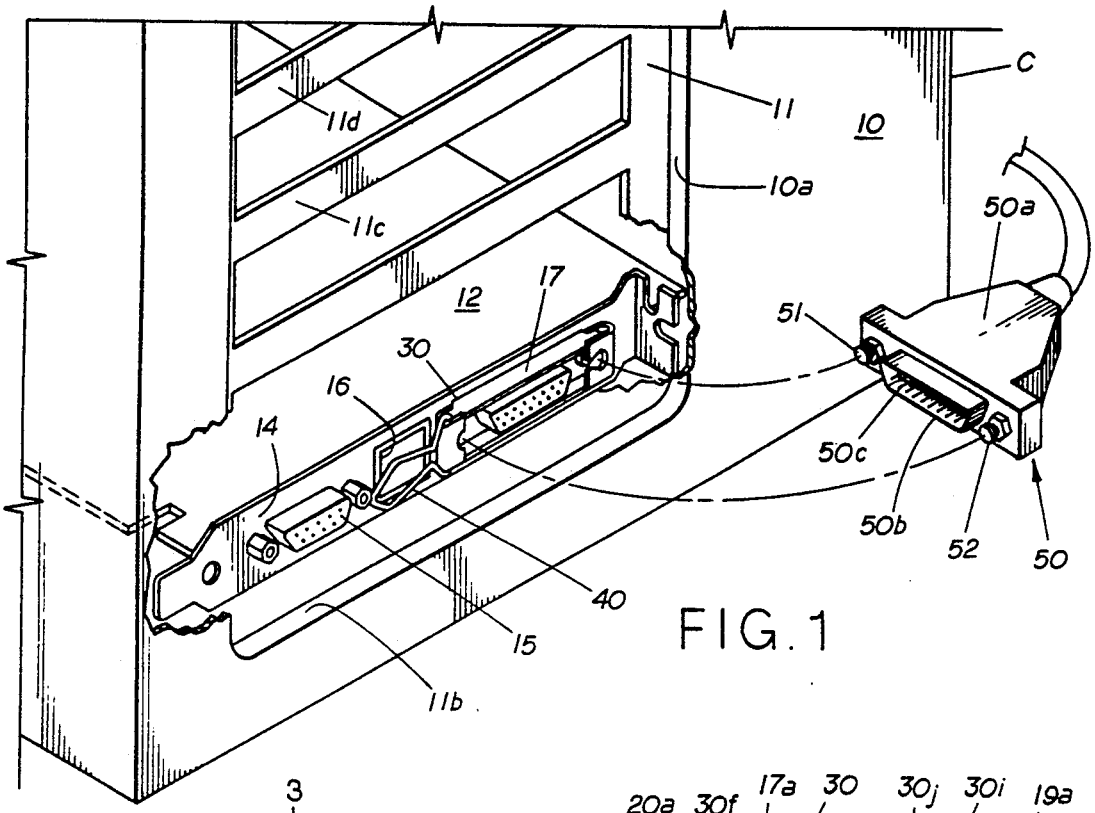
FIG. 1 is a perspective view of part of a computer housing showing an option board which terminates in a series of connectors, one connector being the attachment unit interface connector of this invention.

Referring to the drawings and in particular FIG. 1, a part of a rear corner of a computer housing C is illustrated in a perspective view. The computer housing C includes the rear panel 10 having opening 10*a*. Inside the opening is mounted an option system mounting bracket 11 which is attached to the inside surface of the rear panel 10. The optional system mounting bracket 11 has a configuration typical of such mounting brackets and is attached to the back of the panel 10 by any suitable means. The bracket typically includes a series of slots such as 11*b*, 11*c* and 11*d*. Slot 11*b* is shown as mounting an option circuit board or card generally designated as 12. The circuit board or card 12 has three different electrical connectors for external electrical communication.

The board 12 terminates in a card connector mounting plate 14 which is held in position by mounting in the option board mounting bracket 11 in a known manner. The left-hand connector mounted in the card connector mounting plate 14 is a D-shell 9-pin connector 15, female, providing an STP (shielded twisted pair) port for token ring technology. The center female connector is a 10-base T connector 16 for Ethernet or token ring UTP (unshielded twisted pair) depending upon card configuration.

Neither the STP port connector 15 nor the 10-base T connector 16 form part of this invention but illustrate that the space between such connectors may be quite small and in fact virtually overlapping, thus making it difficult for the user to make and unmake such external connections.

This difficulty is particularly true for a latch-type attachment unit interface connector of the type presently known. The attachment unit interface connector 17 of this invention is illustrated in position in the card connector mounting slot 11*b* adjacent to the 10-base T connector 16. The attachment unit interface connector 17 is a standard AUI connector except for the latch assembly connect and disconnect mechanism to be described here.

Figure 3:
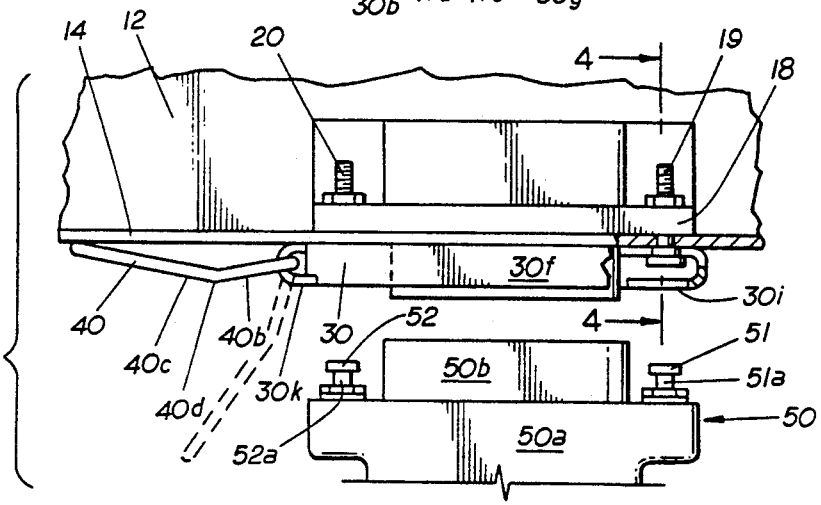
FIG. 3 is a top view partly end section of the connector of FIG. 2 in the latch open position.

The attachment unit interface connector 17 includes an internal interface block 18 which attaches to the board 12 and to the back of the card connector mounting plate 14 as illustrated in FIG. 3. The connection between the interface block 18 and the card connector mounting plate 14 is through the nut and bolt assemblies 19 and 20. Each nut and bolt assembly 19 and 20 extends through the interface connector and the card connector mounting plate to mount the interface connector. Each of the nut and bolt assemblies 19 and 20 terminate in a cap or latch mounting pin identified as 19*a* and 20*a*, respectively.

Figure 4:
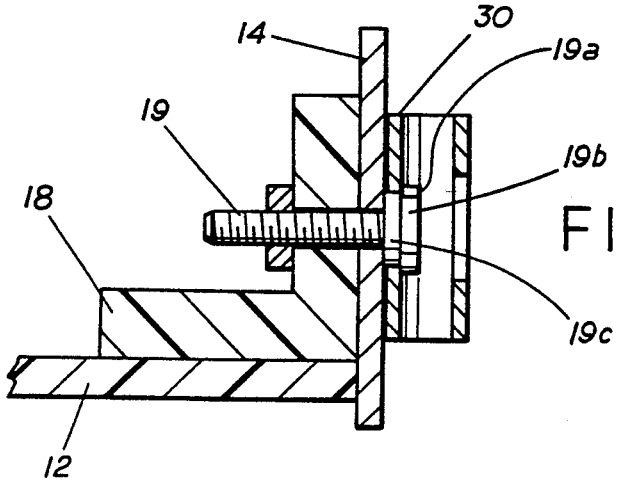
FIG. 4 is a sectional view taken along line 4—4 of FIG. 3 further illustrating the connection of the slidable latch assembly to the female connector.
Figure 5:
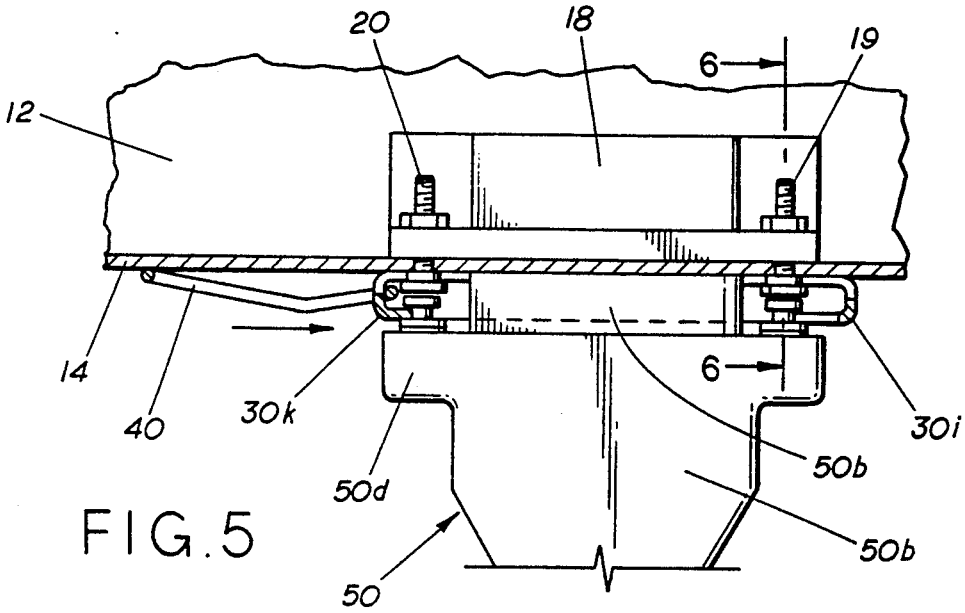
FIG. 5 is a top view of the attachment unit interface connector in the closed position.
Figure 6:
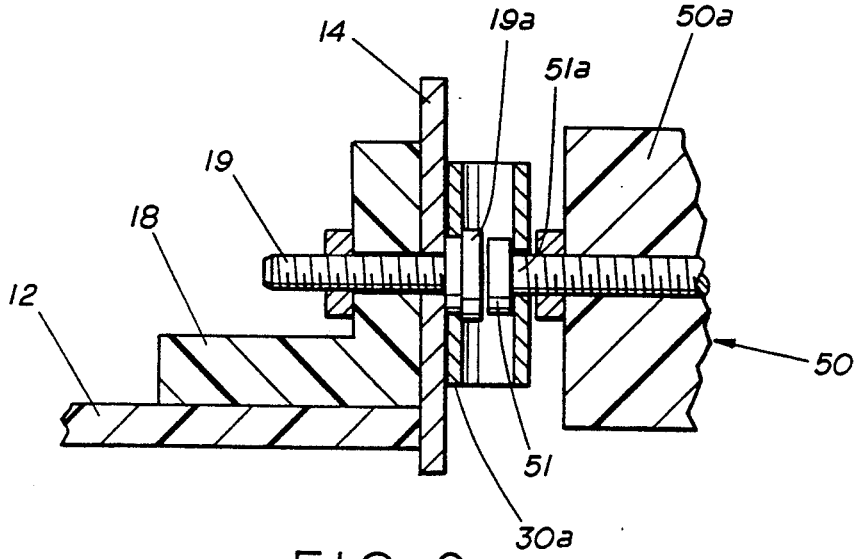
FIG. 6 is a sectional view taken along line 6—6 of FIG. 5 illustrating the engagement of the male and female connecting pins by the latch plate.

Referring to FIGS. 3–6 and in particular to FIGS. 4 and 6, the latch mounting pins such as 19*a* each include an enlarged head area 19*b* and a recessed portion 19*c* of reduced diameter which forms a circular recess in order to receive for slidable movement latch plate 30.

The attachment unit interface connector 17 further includes a plurality of centrally located ports in the form of a D-shell 15-pin port arrangement 17*a*. The D-shell port arrangement 17*a* includes the trapezoidal or D-shaped shell 17*b* housing 15 electrical ports 17*c* which interface with electrical connections in the interface block 18. The 15-pin D-shell central connector portion 17*b* is typically for an Ethernet network connection.

Figure 2:
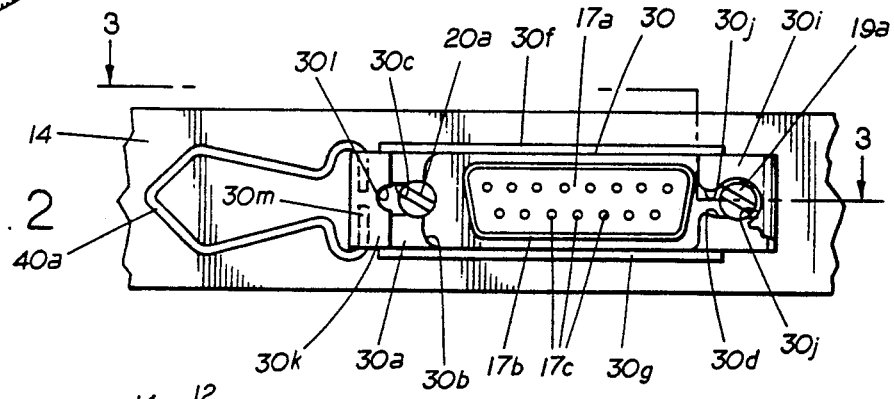
FIG. 2 is a front view of the attachment unit interface connector, female, illustrating the slide latch in a latch open position.

The latch plate 30 includes a base portion 30*a* which mounts the latch plate 30 for slidable movement with respect to latch mounting pins 19*a* and 20*a*. The latch base 30*a* is a generally rectangular member as viewed from the front such as in FIG. 2 and includes a generally rectangular cut-out portion 30*b* so that the latch plate is mounted over the D-shell 17*b*. The base further includes a left side slot 30*c* having slot edges which engage the recess in latch mounting pin 20*a*. Similarly, a somewhat circular slot 30*d* is provided on the right-hand side of the latch base as illustrated in FIG. 2 such that the slot edges engage the recessed area formed by reduced diameter pin portion 19*c*. In this manner, the latch base 30*a* mounts the entire latch 30 for movement between the latch open position as illustrated in FIGS. 2–4 and the latch closed position as illustrated in FIGS. 5–6. The latch further includes an upper, outwardly extending flange 30*f* and a lower, outwardly extending flange 30*g*.

A right side spaced end portion or tab 30*i* is integrally formed with the latch base 30*a* and is bent over to form a generally U-shaped portion as illustrated in the top view of FIG. 3. The spaced end portion or tab portion 30*i* includes a circular recess or opening 30*j* having a diameter slightly larger than the diameter of the pin head 19*a*. The circular recess terminates in ear portions 30*j* which engage a latch attachment pin on the male connector in a manner to be described hereinafter.

The left side of the latch plate 30 also includes a bent over or overlapped end portion which is designated as 30*k* and is also U-shaped as viewed from the top as shown in FIG. 3. The bent over end portion or tab portion 30*k* includes a centrally located semi-circular edge recess 30*l* which engages another of the latch attachment pins on the male connector in a manner to be herein described when the latch plate 30 is in the latch closed position.

The left end spaced tab portion 30*k* in its U-shaped configuration as viewed from FIG. 3 mounts the pull or actuator tab or wire member 40. The purpose of the tab member 40 is to provide access to the latch plate 30 when the latch plate is otherwise inaccessible. The actuator member 40 is a rigid wire member having what may be described as a generally U-shaped configuration in the front view as illustrated in FIGS. 1 and 2 but terminates in a V-shaped end section 40*a* so that either a person's finger or even an instrument such as a screwdriver can easily fit into the V-shaped portion to pull the latch member 40. Viewing the latch member 40 from a top view, it is noted that the latch member 40 includes an attachment section 40*b* which is bent at 40*d* with respect to the outer wire section 40*c* which section 40*c* terminates into the V-shaped portion or section 40*a*. The purpose of the bend 40*d* is to form the fulcrum point to be described hereinafter. The actuator wire 40 terminates in inwardly bent sections 30*m* to mount the wire for pivotal movement.

The male 15-pin D-shell attachment unit interface (AUI) connector is generally identified by the number 50. The male connector 50 includes a housing 50*a* which terminates in a D-shell 50*b* which is complementary to the D-shell 17*b* on the female connector 17 such that when connection is made, the D-shell 50*b* of the male connector fits over the D-shell 17*b* of the female connector and the pins 50*c* are inserted into the ports 17*c* of the female connector. The housing 50*a* includes a first latch attachment pin 51 which is directly alignable with the latch mounting pin head 19*a* when the connectors are attached together such as illustrated in FIGS. 5 and 6. A second latch attachment pin 52 is mounted on the opposite side of the D-shell 50*b* from the latch attachment pin 51 and aligns with the pin head 20*a* of the latch mounting pin 20 when the connectors are attached together such as illustrated in FIG. 5. The latch attachment pin 51 includes a portion 51*a* of reduced diameter to provide a circular recess. Similarly, the latch attachment pin 52 includes a portion 52*a* of reduced diameter to provide a circular recess.

In operation and use, the male connector 50 is aligned with the female connector 17 as illustrated in FIG. 3 and then moved into engagement such that the pins 50*c* are inserted into the ports 17*c*. In order to allow the connection to be made, the latch plate 30 is in the latch open position as illustrated in FIGS. 2–4. In the latch open position, the latch plate is positioned to the left of the latch closed position so that the semi-circular end edge recess 30*l* on the latching end portion 30*k* is out of contact with the pin 52 and similarly, the circular recess 30*j* in the latching end portion 30*i* is directly aligned with the pin member 51 so that the pin member 51 may be inserted through the opening 30*j*. Therefore, in a latch open position, the pin members 51 and 52 are moved into a position of substantial proximity if not engagement with the heads 19*a* and 20*a* of the pins on the female connector.

In order to close the latch member 30 from the open position of FIGS. 2–4 to the latch closed position of FIGS. 5–6, the tab or actuator member 40 may be pushed to the right to move the latch member 30 to the right and thus to the closed position. In the closed position, the bent over latching end portion 30*k*, which is spaced from the base portion 30*a* as illustrated in the top view of FIG. 5, is moved into engagement against the male connector pin 52 such that the circular edge of the semi-circular recess 30*l* engages the male connector pin portion 52*a* of reduced diameter. At the same time, the ears 30*j* on the right-hand spaced tabbed portion 30*i* are moved into a position of engagement with the reduced area 51*a* of pin 51 such that the bent over tab portions 30*k* and 30*i* engage the male connector pins 51 and 52 to hold the male connector in a connected position against the female connector.

As the reader can see from the view in FIG. 1, the connection area is very crowded when a male connector is provided for each of the female connectors 15, 16 and 17. Without the pivotally mounted actuator member 40, it is extremely difficult for someone to access the latch member 30 in order to move the latch member to either the closed or open position. With the addition of the tab member 40 in its pivotally mounted position with the latch plate 30, a user may simply insert his or her finger into the wire loop of the tab member 40 to move the latch member 30 from the latch close position of FIGS. 5 and 6 to the latch open position of FIGS. 2–4. In the alternative, the corner **40*d* of the bent portion of the latch member 40 may be rotated into a position of engagement against the wing 50*d* of the male connector housing 50*a* so that pressure may be applied to the V-shaped end to cause the tab member 40 to pivot so that the latch member is moved to the latch open position. Thus the bent portion 40*d* when in engagement against the male connector housing wing 50*d*, is used as a fulcrum to pivot the tab member 40** thus causing movement of the latch plate from right to left and thus from the latch closed to the latch open position.

Having described the invention above, various modifications of the techniques, procedures, material and equipment will be apparent to those in the art. For example, while the combination of an accessible actuator member for the latch 30 has been described for the particular attachment unit interface connector 17, this invention may be applied to other latchable electrical connectors. It is intended that all such variations within the scope and spirit of the appended claims be embraced.

We claim:

1. An attachment unit interface connector utilizing a slide latch which is easily latched and unlatched, comprising:

a female connector, said female connector including a housing having a plurality of centrally located ports adapted to receive male plug or pin elements from a male connector, said housing having a first latch mounting pin positioned on one side of said centrally located ports and a second latch mounting pin positioned on another side of said centrally located ports, each of said first and second latch mounting pins including a recess;

said female connector further including a slidable latch plate which includes a latch base having slots which are alignable with said first and second latch mounting pins to slidably mount said latch plate for movement between a latch closed and a latch open position;

said latch base including a first, integrally formed, overlapped, spaced actuator portion which includes a pin receiving slot and a second, integrally formed, overlapped, spaced actuator portion including a pin receiving slot;

a male connector, said male connector including a housing having a plurality of centrally located electrical conducting pins which are alignable with said centrally located ports of said female connector to form an electrical connection;

said male connector including a first latch attachment pin positioned on one side of said centrally located electrical conducting pins and a second latch attachment pin positioned on another side of said centrally located electrical conducting pins, said first and second latch attachment pins of said male connector being aligned with said first and second latch mounting pins of said female connector with said centrally located pins of said male connector inserted into said centrally located ports of said female connector, said first and second latch attachment pins each having a recess;

said pin receiving slots of said spaced actuator portions of said slide latch being moved out of engagement with said male connector first and second attachment pins with said latch in said latch open position and being in engagement with said male connector first and second attachment pins in said latch closed position such that said first and second connectors are latched together by said sliding latch plate; and an actuator tab being attached to either of said first or second spaced actuator portions of said latch, said actuator tab being a rigid wire loop mounted for pivotal movement and extending outwardly from said male and female connector housings so that said actuator tab may be easily accessed with said latch plate in said latch closed position.

2. The structure set forth in claim 1, including:

said first spaced actuator portion being movable away from said first latch attachment pin with said latch plate in said latch open position;

said rigid wire loop being attached to said first spaced actuator portion of said latch plate.

3. The structure set forth in claim 1, including:

said actuator tab having an opening which can receive finger of an operator.

4. The structure set forth in claim 1, including: said actuator tab including a V-shaped extending portion for receiving a tool.

5. An attachment unit interface connector utilizing a slide latch which is easily latched and unlatched, comprising:

a female connector, said female connector including a housing having a plurality of centrally located ports adapted to receive male plug or pin elements from a male connector, said housing having a first latch mounting pin positioned on one side of said centrally located ports and a second latch mounting pin positioned on another side of said centrally located ports, each of said first and second latch mounting pins including a recess;

said female connector further including a slidable latch plate which includes a latch base having slots which are alignable with said first and second latch mounting pins to slidably mount said latch plate for movement between a latch closed and a latch open position;

said latch base including a first, integrally formed, overlapped, spaced actuator portion which includes a pin receiving slot and a second, integrally formed, overlapped, spaced actuator portion including a pin receiving slot;

a male connector, said male connector including a housing having a plurality of centrally located electrical conducting pins which are alignable with said centrally located ports of said female connector to form an electrical connection;

said male connector including a first latch attachment pin positioned on one side of said centrally located electrical conducting pins and a second latch attachment pin positioned on another side of said centrally located electrical conducting pins, said first and second latch attachment pins of said male connector being aligned with said first and second latch mounting pins of said female connector with said centrally located pins of said male connector inserted into said centrally located ports of said female connector, said first and second latch attachment pins each having a recess;

said pin receiving slots of said spaced actuator portions of said slide latch being moved out of engagement with said male connector first and second attachment pins with said latch in said latch open position and being in engagement with said male connector first and second attachment pins in said latch closed position such that said first and second connectors are latched together by said sliding latch plate;

an actuator tab being attached to either of said first or second spaced actuator portions of said latch, said actuator tab being a rigid wire loop mounted for pivotal movement and extending outwardly from said male and female connector housings so that said actuator tab may be easily accessed with said latch plate in said latch closed position; and said actuator tab having a pivot section including a bent portion forming a point adapted to engage said male connector housing so that said actuator tab can be pivoted about said point in engagement with said male connector housing in order to slide said latch plate to said latch open position.

6. An attachment unit interface connector utilizing a slide latch which is easily latched and unlatched, comprising:

a male connector, said male connector including a housing having a plurality of centrally located electrical conducting pins adapted to be inserted into ports of a female connector, said male connector housing having a first latch mounting pin positioned on one side of said centrally located pins and a second latch mounting pin positioned on another side of said centrally located electrical conducting pins, each of said first and second latch mounting pins including a recess;

said male connector further including a slidable latch plate which includes a latch base having slots which are alignable with said first and second latch mounting pins to slidably mount said latch plate for movement between a latch closed and a latch open position;

said latch base including a first, integrally formed, overlapped, spaced actuator portion which includes a pin receiving slot and a second, integrally formed, overlapped, spaced actuator portion including a pin receiving slot;

a female connector, said female connector including a housing having a plurality of centrally located electrical conducting ports which are alignable with said centrally located pins of said male connector to form an electrical connection;

said female connector including a first latch attachment pin positioned on one side of said centrally located electrical conducting ports and a second latch attachment pin positioned on another side of said centrally located electrical conducting ports, said first and second latch attachment pins of said female connector being aligned with said first and second latch mounting pins of said male connector with said centrally located electrically conducting pins of said male connector inserted into said centrally located ports of said female connector, said first and second latch attachment pins each having a recess;

said pin receiving slots of said spaced actuator portions of said slide latch mounted on said male connector being moved out of engagement with said female connector first and second attachment pins with said latch in said latch open position and being in engagement with said female connector first and second attachment pins in said latch closed position such that said first and second connectors are latched together by said sliding latch plate; and an actuator tab being attached to either of said first or second spaced actuator portions of said latch, said actuator tab being a rigid wire loop mounted for pivotal movement and extending outwardly form said male and female connector housings that said actuator tab may be easily accessed with said latch plate in said latch closed position.

* * * * *